United States Patent [19]

Brunsell et al.

[11] 4,272,343

[45] Jun. 9, 1981

[54] PROCESS FOR THE ELECTROLYTIC REDUCTIVE LEACHING OF ILMENITE ORE

[75] Inventors: Dennis A. Brunsell, Oklahoma City; Olen L. Riggs, Jr., Bethany, both of Okla.

[73] Assignee: Kerr-McGee Corporation, Oklahoma City, Okla.

[21] Appl. No.: 110,674

[22] Filed: Jan. 9, 1980

[51] Int. Cl.[3] ..... C25C 1/00

[52] U.S. Cl. ..... 204/130; 204/105 R; 423/85; 423/86; 423/140

[58] Field of Search ..... 204/105 R, 113, 130; 423/140, 82, 83, 85, 86

[56] References Cited

U.S. PATENT DOCUMENTS

| | | | |
|---|---|---|---|
| 1,084,351 | 1/1914 | MacKay | 204/275 |
| 1,198,024 | 9/1916 | Greenawalt | 204/108 |
| 1,615,970 | 2/1927 | Wetherbee | 204/108 |
| 1,655,940 | 1/1928 | D'Ans et al. | 423/83 |
| 1,858,944 | 5/1932 | Tainton | 204/107 |
| 1,886,163 | 11/1932 | Christensen | 204/118 |
| 2,441,856 | 5/1948 | Turner et al. | 204/113 |
| 2,955,078 | 10/1960 | Raynes | 204/64 |
| 3,627,508 | 12/1971 | Hughes et al. | 75/1 |
| 3,737,381 | 6/1973 | White et al. | 204/263 |
| 3,790,458 | 2/1974 | Demura et al. | 204/96 |
| 3,808,117 | 4/1974 | Spendlove et al. | 204/234 |
| 3,825,419 | 7/1974 | Chen | 75/101 |

*Primary Examiner*—R. L. Andrews

*Attorney, Agent, or Firm*—William G. Addison

[57] ABSTRACT

A process for beneficiating ilmenite ore using electrolytic reduction. The ilmenite ore is admixed with an acidic solution to form a mixture. The mixture is electrolytically reduced to convert at least a portion of any ferric iron that is present to ferrous iron. The acidic solution dissolves the ferrous iron in the ilmenite ore and yields beneficiated ilmenite having a relatively high titanium dioxide content.

8 Claims, No Drawings

PROCESS FOR THE ELECTROLYTIC REDUCTIVE LEACHING OF ILMENITE ORE

BACKGROUND OF THE INVENTION

1. Field of the Invention

The present invention provides a process for the beneficiation of ilmenite ore employing an electrolytic reduction step.

2. Description of the Prior Art

In conventional processes for the production of titanium dioxide from ilmenite ore, such as those disclosed in U.S. Pat. Nos. 3,825,419 or 3,627,508, the ore is reduced prior to acid leaching to convert ferric iron values present in the ore to the more soluble ferrous state. The ore is reduced in a reductive kiln using coal, coke, oil or natural gas as the reductant. The reduction generally is allowed to approach only about 90–95 percent of complete ferric iron reduction to avoid the formation of metallic iron. The presence of any metallic iron in the ore introduced into the acid leaching apparatus can create extremely explosive conditions within the leaching apparatus. That is, hydrogen gas is evolved from the leach solution should it come in contact with metallic iron.

Reduction of the ilmenite ore prior to acid leaching increases the rate of dissolution of iron from the ore, as compared to raw ore, but the leaching process still requires a long digestion period. During the leaching process, a portion of the titanium contained in the ore is dissolved. As the leaching continues, the dissolved titanium hydrolyzes to produce titanium dioxide. If any ferric iron is present, hydrolysis results in the formation of an insoluble ferric iron-titanium compound from which it is very difficult to remove the iron. The iron-titanium compound has an undesirable redish brown color which can discolor titanium dioxide produced from the reduced ore.

The ferrous iron dissolved in the leach solution appears to be unreactive with the dissolved titanium under the leach conditions and can be separated from the leach solution by precipitation as ferrous chloride.

There is a need in the industry for a process which avoids the formation of a ferric iron-titanium compound during leaching and also reduces the time required to effect iron removal from the ilmenite ore.

Various electrolytic processes and apparatus have been developed for extracting metals from their ores or regenerating leach liquids use to extract metals from their ores. Such processes are disclosed in, for example: U.S. Pat. Nos. 1,084,351; 1,198,024; 1,615,970; 1,858,944; 1,886,163; 2,441,856; 2,955,078; 3,737,381; 3,790,458; and 3,808,117.

SUMMARY OF THE INVENTION

The present invention provides a process the practice of which results in a reduction in the time required to effect iron removal from ilmenite ore and avoids the formation of undesirable iron-titanium compounds as a result of hydrolysis during ore leaching.

The process is effected by electrolytically rducing the ilmenite ore during the leaching process. Electrolytic reduction increases the rate of dissolution of the iron contained in the ore. This reduces the time required to process the ore.

An electrolytic cell is positioned within the leaching apparatus or a stream of the leach solution is withdrawn from the apparatus and pumped through a separate apparatus comprising an electrolytic cell. The leach solution is introduced into the electrolytic cell as the catholyte. A diaphragm separates the anode and cathode compartments of the electrolytic cell to prevent oxidation of the catholyte solution by the anode. The electrolysis may be carried out under constant current, constant voltage or potentiostatic conditions. Potentiostatic control is preferred since the electrode can be maintained at the optimum potential versus a reference electrode for the reduction of the iron and titanium in the leach solution.

If the reduction is carried beyond the electrochemical potential corresponding to the ferrous iron level, trivalent titanium is formed in the leach solution. The trivalent titanium chemically attacks any ferric iron compounds that may be present in the leach solution. The chemical attack converts the ferric iron to ferrous iron and thereby avoids the formation of a ferric iron-titanium compound upon hydrolysis of dissolved titanium values in the leach solution.

DESCRIPTION OF THE PREFERRED EMBODIMENT

The electrolytic reduction process of the present invention can be used to replace a reductive furnace or to aid in the completion of the reduction effected by a furnace for the production of titanium dioxide from ilmenite ore.

In a preferred embodiment, the electrolytic process is used to eliminate the use of a reduction furnace. The ilmenite ore is admixed with an acidic leach solution in a leaching vessel. The leaching agent is a dilute mineral acid, and preferably is hydrochloric acid, although sulfuric, nitric, phosphoric or hydrofluoric acid may be employed. The acid is present in the solution in an amount sufficient to provide a concentration of from about 18 to 37 percent acid by weight. The acid preferentially attacks iron values at these dilute concentrations and has little effect upon the titanium values. At acid concentrations above 25 percent, significant quantities of the titanium values in the ore will begin to solubilize with no compensating acceleration in the solubilization rate of the iron values. The acid, whether hydrochloric or one of the other acids mentioned above, should be present in an excessive molar amount for solubilizing all of the iron values contained in the ore.

In one embodiment, an electrolytic cell assembly is placed within the leaching vessel. The electrolytic cell consists of large surface area cathodes comprising materials such as, for example, cast iron, steel, titanium or base metals coated with noble metals such as platinum. Preferably, the cathodes comprise the walls of the leaching vessel. The anodes have a small surface area in comparison to the cathodes to provide a high current density during cell operation. The anodes comprise materials such as, for example, titanium or base metals coated with platinum, ruthenium oxide or the like. Preferably, the ratio of surface area of the cathodes to surface area of the anodes is in excess of 2:1. The leaching solution comprises the catholyte in the electrolytic cell. The catholyte is separated from the anodes and an anolyte solution by a diaphragm. The diaphragm prevents chemical oxidation of the reduced catholyte solution by the anodes in the electrolytic cell. The anolyte can comprise mineral acid, such as for example, hydrochloric acid present in an amount sufficient to provide a concentration of from about 10 to 37 percent acid by weight.

The electrolysis may be performed under constant current, constant voltage or potentiostatic conditions. Preferably, the electrolytic cell is operated under potentiostatic control since this permits the cathode to be maintained at the optimum potential versus a reference electrode for the reduction of the iron in the ore. The reference electrode can comprise a standard calomel electrode or any other conventional or especially designed reference electrode. When a calomel electrode is employed as the reference electrode, the electrochemical potential measured between the cathode and the reference electrode is maintained in the range of from about −100 millivolts to about −400 millivolts to reduce the iron in the ore to the ferrous state. Constant current or constant voltage control is effected by methods well known by those skilled in the art.

If the reduction within the cathode compartment is controlled to carry the reduction of the ore beyond the ferrous iron level, trivalent titanium is formed in the leach solution. Ferric iron can not exist in the presence of trivalent titanium. The trivalent titanium oxidizes to the quadrivalent form and the ferric iron in the ore is reduced to ferrous iron that rapidly dissolves in the leach solution. The ferrous iron appears to be unreactive with the titanium dissolved in the leach solution. The presence of the trivalent titanium in the leach solution ensures that no ferric iron-titanium compounds are formed by hydrolysis of the dissolved titanium in the leach solution.

The temperature at which the leaching is effected preferably should be greater than 50° C. to ensure an efficient and relatively rapid solubilization of the iron values. Also, the leaching temperature preferably is maintained below the boiling point of the acid being used to prevent the acid from boiling off and being wasted. However, higher temperatures can be employed at elevated pressures.

The pressure at which the leaching is performed preferably is atmospheric pressure. However, higher pressures can be employed. Generally, the pressure within the vessel will tend to increase slightly above atmospheric pressure as a result of gas evolution during the leaching operation.

At the conclusion of the leaching operation, substantially all of the iron values present in the ore will be solubilized. It has been found that leaching, employing the electrolytic cell of the present invention to effect reduction of the iron in the ore, is accomplished in less than half the time required to leach raw ore and is comparable to the time required to leach ore that has been thermally reduced in, for example, a kiln under similar conditions.

The leach liquor is separated from the beneficiated ore by filtration, centrifugation or the like. The beneficiated ore now contains a substantially higher titanium dioxide content than the raw ore. The beneficiated ore can be in excess of 90 percent titanium dioxide.

The leach liquor contains solubilized ferrous salts and preferably the salts of chlorine. The liquor also contains some dissolved titanium values. The quantity of dissolved titanium values can be increased by increasing the acid concentration in the leach solution. The dissolved titanium values can be recovered by hydrolysis of the leach liquor to produce titanium dioxide. First, the leach liquor is cooled to a sufficiently low temperature to cause the ferrous salts to crystallize and precipitate. The precipitate ferrous salts then are separated from the leach liquor by filtration, centrifugation or the like. The leach liquor then is treated to hydrolyze the dissolved titanium values and precipitate a crude form of titanium dioxide. The precipitate is of a generally white color and is formed without the precipitation of iron-titanium compounds which would contaminate and discolor the product. The precipitate then can be separated from the leach liquor and employed as a low quality pigment material without the necessity of additional purification.

In an alternate embodiment of the present invention, the electrolytic cell comprises a separate vessel. In this instance, a portion of the leach liquor slurry is withdrawn from the leaching vessel and pumped through a conduit connected to the cathode compartment of the cell. The slurry is electrolyticly reduced and then returned to the leaching vessel. Thereafter, the leach liquor slurry is treated as previously described to separate the dissolved iron values.

To illustrate the invention, and not by way of limitation, the following example is provided.

EXAMPLE

A 50 gram sample of an ilmenite ore comprising 58.6% $TiO_2$, 1.4% FeO and 24.9% $Fe_2O_3$ is admixed with 500 ml. of concentrated hydrochloric acid solution and introduced into a leach vessel. The solution is stirred and maintained at a temperature of about 55 degrees C. Samples periodically are withdrawn for analysis of the dissolved iron content. The results of the analysis are set forth in Table I, below.

TABLE I

| Time, Hrs. | Fe in leach solution, mg./l. |
|---|---|
| 1 | 3100 |
| 2 | 3800 |
| 3 | 5600 |
| 6½ | 8000 |

A second 50 gram sample of the ilmenite ore is admixed with 500 ml. of 20 percent hydrochloric acid solution and introduced into an electrolytic cell as the catholyte. The anolyte is concentrated hydrochloric acid solution. The anolyte is separated from the catholyte by an alumina oxide diaphragm. The cathode is platinum and the anode is ruthenium oxide coated titanium. The electrolytic cell is potentiostatically controlled employing a standard calomel reference electrode. The electrochemical potential measured between the cathode and reference electrode is maintained at −200 millivolts. The catholyte is stirred and maintained at 55 degrees C. Samples of the catholyte periodically are withdrawn for analysis. The results of the analysis are set forth in Table II, below.

TABLE II

| Time, Hrs. | Fe in leach solution, mg./l. |
|---|---|
| 1 | 5200 |
| 2 | 9900 |
| 3 | 11000 |
| 6½ | 17000 |

The results clearly illustrate the substantial improvement which occurs in the rate of iron dissolution in electrolytically reduced ilmenite ore over non-electrolytically reduced raw ore during acid leaching.

While the present invention has been described with respect to what are considered to be the preferred embodiments thereof, it is to be understood that changes or modifications can be made in the process without departing from the spirit or scope of the invention as defined by the following claims.

What is claimed is:

1. A process for beneficiation of ilmenite ore, comprising:

admixing ilmenite ore with an acidic solution;

electrolytically reducing at least a portion of said ilmenite ore contained in said admixture to convert ferric iron in said ilmenite ore into ferrous iron; and dissolving a substantial portion of said ferrous iron from said ilmenite ore to produce beneficiated ilmenite ore.

2. The process of claim 1 wherein the electrolytic reduction of the ilmenite ore in the admixture is effected in the cathode compartment of an electrolytic cell.

3. The process of claim 2 wherein the electrolytic cell is contained within a leaching vessel.

4. The process of claim 1 wherein the electrolytic reduction of the ilmenite ore is potentiostatically controlled.

5. The process of claim 4 wherein the electrochemical potential measured between a cathode and a standard calomel reference electrode immersed in the admixture of ilmenite ore and acidic solution is maintained in the range of from about −100 millivolts to −400 millivolts by said potentiostatic control.

6. The process of claim 1 wherein the acidic solution is a hydrochloric acid solution.

7. The process of claim 6 wherein the hydrochloric acid is present in the solution in a concentration of from about 18 to 37 percent, by weight.

8. The process of claim 1 defined further to include the steps of:

dissolving a portion of said beneficated ilmenite ore whereby a portion of any titanium values contained therein also dissolves in said acidic solution;

separating said acidic solution from any remaining undissolved beneficiated ilmenite ore;

cooling said acidic solution containing both dissolved ferrous iron and titanium values to precipitate a ferrous iron salt;

separating said precipitate from said acidic solution; and precipitating said dissolved titanium values by hydrolysis of said acidic solution to produce titanium dioxide.

* * * * *